US009079056B1

(12) United States Patent
McAlpin

(10) Patent No.: US 9,079,056 B1
(45) Date of Patent: Jul. 14, 2015

(54) CHEERLEADER SUPPORT SYSTEM

(71) Applicant: Patrick K. McAlpin, New Port Richey, FL (US)

(72) Inventor: Patrick K. McAlpin, New Port Richey, FL (US)

( * ) Notice: Subject to any disclaimer, the term of this patent is extended or adjusted under 35 U.S.C. 154(b) by 0 days.

(21) Appl. No.: 14/085,915

(22) Filed: Nov. 21, 2013

Related U.S. Application Data

(63) Continuation-in-part of application No. 12/804,218, filed on Jul. 16, 2010, now Pat. No. 8,591,383.

(60) Provisional application No. 61/226,362, filed on Jul. 17, 2009.

(51) Int. Cl.

| | |
|---|---|
| ***A63B 4/00*** | (2006.01) |
| ***A63B 26/00*** | (2006.01) |
| ***A63B 23/04*** | (2006.01) |
| ***A63B 21/00*** | (2006.01) |

(52) U.S. Cl.
CPC ..... *A63B 4/00* (2013.01); *A63B 21/00047* (2013.01); *A63B 23/0458* (2013.01); *A63B 26/003* (2013.01)

(58) Field of Classification Search
USPC ..... 482/23, 25, 34, 15, 18, 142, 148; 297/175, 187, 195.1, 423.1
See application file for complete search history.

(56) References Cited

U.S. PATENT DOCUMENTS

| | | | | |
|---|---|---|---|---|
| 4,448,411 | A * | 5/1984 | Parker | 482/34 |
| 4,703,928 | A * | 11/1987 | Escher | 482/110 |
| 4,850,588 | A * | 7/1989 | Desjardins et al. | 482/51 |
| 5,810,751 | A * | 9/1998 | Meier et al. | 601/24 |
| 5,865,710 | A * | 2/1999 | Wilson-Hyde | 482/52 |
| 6,071,212 | A * | 6/2000 | Hodlmoser | 482/25 |
| 6,524,355 | B1 * | 2/2003 | Jenkins | 48/52 |
| 7,112,168 | B2 * | 9/2006 | Dalebout et al. | 482/146 |
| 7,722,506 | B2 * | 5/2010 | Pratson et al. | 482/52 |
| 7,794,378 | B2 * | 9/2010 | Splane et al. | 482/142 |
| 7,892,154 | B1 * | 2/2011 | Alexa | 482/112 |
| 8,105,219 | B1 * | 1/2012 | Sloan et al. | 482/146 |
| 2004/0248714 | A1 * | 12/2004 | Johnsen | 482/142 |
| 2006/0232109 | A1 * | 10/2006 | Olano | 297/195.11 |
| 2008/0020900 | A1 * | 1/2008 | Wang | 482/25 |
| 2010/0183814 | A1 * | 7/2010 | Rios et al. | 427/387 |
| 2012/0329621 | A1 * | 12/2012 | Lorentz, II | 482/139 |

* cited by examiner

*Primary Examiner* — Loan H Thanh
*Assistant Examiner* — Sundhara Ganesan

(57) ABSTRACT

A vertically oriented shaft has a vertically oriented central axis. A lower plate has a configuration with an upper surface integrally formed with the lower end of the shaft. An upper plate has a geometric configuration with a periphery, a lower surface integrally formed with the upper end of the shaft, and an upper surface. A base plate has a center located on the central axis of the shaft. The base plate has an upper surface in facing contact with and separably coupled to the lower surface of the lower plate. The system has a reduced center of gravity for maximum safety, particularly for preteen users.

18 Claims, 2 Drawing Sheets

CHEERLEADER SUPPORT SYSTEM

RELATED APPLICATION

The present application is a continuation-in-part of pending application Ser. No. 12/804,218 filed Jul. 16, 2010, which in turn is based upon Provisional Patent Application No. 61/226,362 filed Jul. 17, 2009, the subject matter of which applications is incorporated herein by reference.

BACKGROUND OF THE INVENTION

Field of the Invention

The present invention relates to a cheerleader support system and more particularly pertains to receiving and holding a cheerleader in a predetermined position while practicing athletic routines requiring flexibility, balance and stamina, the receiving and holding being done in a safe, convenient and economical manner, particularly for pre-teen users.

SUMMARY OF THE INVENTION

In view of the foregoing disadvantages inherent in the types of support systems of known designs and configurations now present in the prior art, the present invention provides an improved cheerleader support system. As such, the general purpose of the present invention, which will be described subsequently in greater detail, is to provide a new and improved cheerleader support system and method which has all the advantages of the prior art and none of the disadvantages.

To attain this, the present invention essentially comprises a cheerleader support system. First provided a vertically oriented shaft has a vertically oriented central axis. A lower plate has a configuration with an upper surface integrally formed with the lower end of the shaft. An upper plate has a geometric configuration with a periphery and having a lower surface integrally formed with the upper end of the shaft and having an upper surface. A base plate has a center located on the central axis of the shaft. The base plate has an upper surface in facing contact with and separably coupled to the lower surface of the lower plate. The system has a reduced center of gravity for maximum safety, particularly for pre-teen users.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved cheerleader support system which has all of the advantages of the prior art support systems of known designs and configurations and none of the disadvantages.

It is another object of the present invention to provide a new and improved cheerleader support system which may be easily and efficiently manufactured and marketed.

It is a further object of the present invention to provide a new and improved cheerleader support system which is of durable and reliable constructions.

An even further object of the present invention is to provide a new and improved cheerleader support system which is susceptible to a low cost of Manufacture with regard to both materials and labor, and which accordingly is then susceptible of low prices of sale to the consuming public, thereby making such cheerleader support system economically available to the buying public.

Even still another object of the present invention is to provide a cheerleader support system for receiving and holding a cheerleader in a predetermined position while practicing athletic routines requiring flexibility, balance and stamina, the receiving and holding being done in a safe, convenient and economical manner, particularly for pre-teen users.

Lastly, it is an object of the present invention to provide a new and improved cheerleader support system for receiving and holding a cheerleader in a predetermined position while practicing athletic routines requiring flexibility, balance and stamina.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated primary and preferred embodiment of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 2:
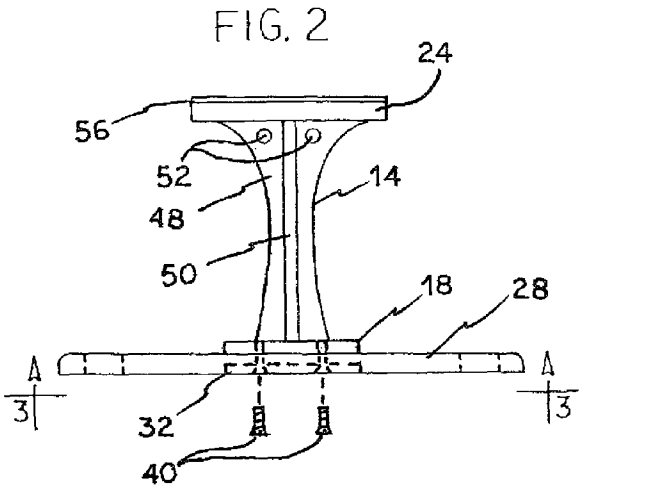
FIG. 2 is an enlarged side elevational view, partially exploded, of the cheerleader support system shown in FIG. 1.
Figure 3:
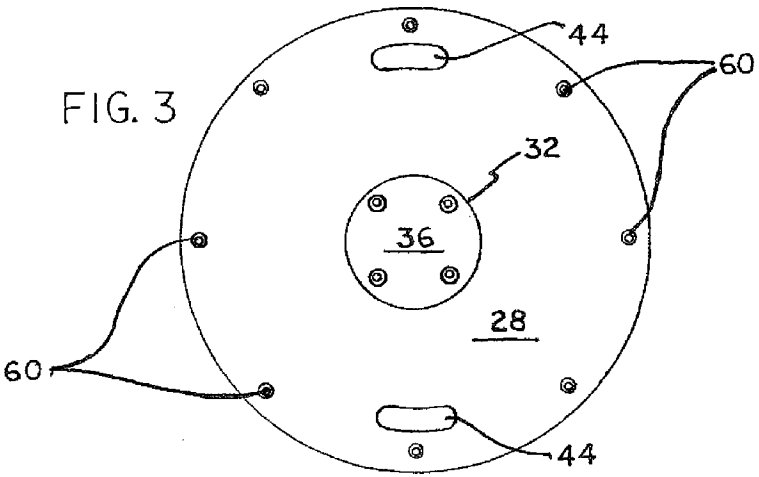
FIG. 3 is a bottom view of the system taken along line 3-3 of FIG. 2.
Figure 1:
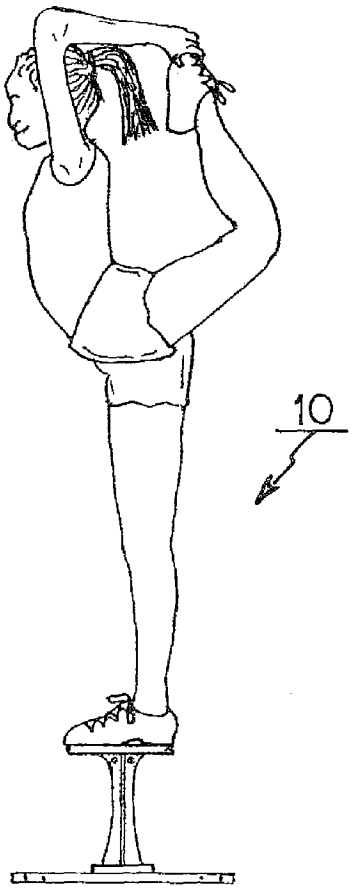
FIG. 1 is a side elevational view of a cheerleader support system constructed in accordance with the principles of the present invention, the system being illustrated while in use.

With reference now to the drawings, and in particular to FIG. 1 thereof, the preferred embodiment of the new and improved cheerleader support system embodying the principles and concepts of the present invention and generally designated by the reference numeral 10 will be described.

The present invention, the cheerleader support system 10 is comprised of a plurality of components. Such components in their broadest context include a vertically oriented shaft, a lower plate, an upper plate and a base plate. Such components are individually configured and correlated with respect to each other so as to attain the desired objective.

First provided is a vertically oriented central shaft 14. The central shaft has an upper end. The central shaft has a lower end. The central shaft has a vertically oriented central axis. The central axis is provided between the upper and lower ends. The preferred length of the central axis is 9 inches, plus or minus 20 percent.

A lower plate 18 is provided. The lower plate has a configuration with a center. The center is located on the central axis of the central shaft. The lower plate has a flat upper surface. The upper surface is integrally formed with the lower end of the central shaft. The lower plate has a diameter. The preferred diameter is 4.625 inches, plus or minus 20 percent. The lower plate has a flat lower surface. Apertures, preferably four, are provided in the lower plate.

Provided next is an upper plate 24. The upper plate has a generally rectangular configuration. The upper plate has short sides. The upper plate has concave long sides. The upper plate has a flat lower surface. The lower surface is integrally formed with the upper end of the central shaft. The upper plate has a maximum length. The preferred maximum length is 9 inches, plus or minus 20 percent. The upper plate has a maximum width. The preferred maximum width is 3.6 inches, plus or minus 20 percent. The upper plate has a center. The center is located on the central axis of the central shaft. The upper plate has a flat upper surface. In this manner a foot of the cheerleader is received. Further in this manner a foot of the cheerleader is held in a predetermined position while practicing athletic routines requiring flexibility, balance and stamina.

Further provided is a base plate 28. The base plate has a circular configuration. The base plate has a center. The center is located on the central axis of the central shaft. The base plate has a flat upper surface. The upper surface is provided in facing contact with the lower surface of the lower plate. The base plate has a diameter. The preferred diameter is 18 inches, plus or minus 20 percent. The lower plate has a flat lower surface. The lower surface is positionable upon a floor. The base plate is axially aligned with the lower plate. The lower surface of the base plate has a cylindrical recess 32. The cylindrical recess has a diameter. The preferred diameter is 4.5 inches, up to 20 percent greater.

Provided next is a retainer disk 36. The retainer disk has a diameter. The preferred diameter is 4.5 inches, down to 20 percent less. The preferred depth is 0.5 inches, plus or minus 20 percent. The retainer disk is located within the recess. The retainer disk has apertures axially aligned with apertures of the lower plate and the base plate. Bolts 40 are provided. Four apertures and four bolts are the preferred numbers. The bolts are inserted through the apertures of the disk, base plate and lower plate. In this manner the system is threadedly joined for use.

The preferred height of the system is between 7 and 11 inches and the diameter of the base plate is between 16 and 20 inches. The system has a height to width ratio of 1 to 2.

Figure 5:
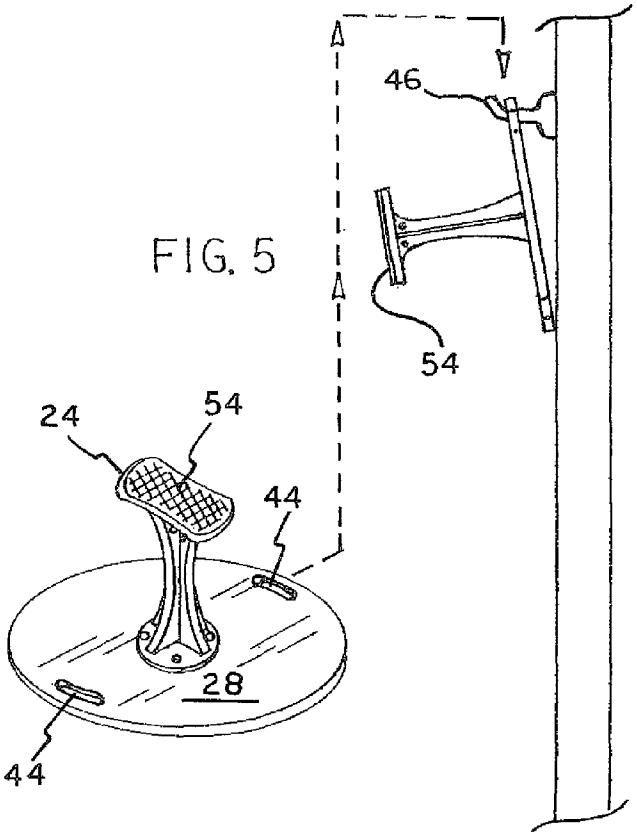
FIG. 5 is a perspective illustration of the system resting on a support surface such as a floor prior to usage and illustrating the system supported during storage.
Figure 4:
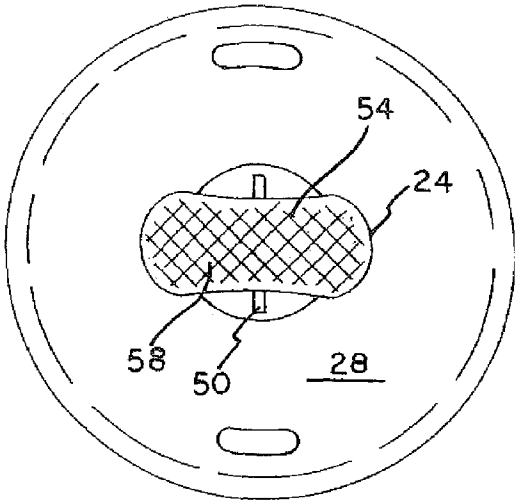
FIG. 4 is a plan view of the system taken along line 4-4 of FIG. 2.

Lifting holes 44 are formed in the base plate. The preferred number of lifting holes is two. Each arcuate lifting hole is adapted to receive a peg 46 extending from a wall for supporting the system at an elevated location for storage. Note FIG. 5.

Lateral braces extend between the upper plate and the lower plate. In the preferred embodiment, the lateral braces include two wide braces 48 and two narrow braces 50. Reducing apertures 52 are formed in the wide braces adjacent to the upper plate. The preferred number of reducing apertures is two. The reducing apertures function to lower the center of gravity of the system so as to maximize safety through abatement of unintended tipping.

A friction sheet 54 in next provided. The friction sheet includes an upper surface and a lower surface and a periphery corresponding to the periphery of the upper plate. The lower surface has an adhesive 56 attaching the friction sheet to the upper plate. The upper surface has a pattern of anti-skid material 58, preferably grit, to increase friction between the system and the cheerleader during use.

Lastly, pilot holes 60 extend into the base plate in a concentric, circular configuration radially spaced from the shaft. The preferred number of pilot holes is eight. The pilot holes are adapted to receive and support elastomeric pads extending downwardly from the lower surface of the base plate to abate sliding of the system during use.

The present invention is a cheerleader balancing and core strengthening, height-sensitive training system. It provides a safe, stable platform. It is preferably fabricated of high-strength extruded alloy T-6063 aluminum, corrosion-dipped, electrostatic powder-coated for maximum durability. It is a safe and stable platform for an inexperienced beginner and cheerleaders in general which allows the building of skills at any level. It is stable, allowing the athlete to practice aligning his/her point of contact. The present invention has a non-skid top and rubberized foot to maintain solid contact with the shoe and floor at all times. It is ergonomically designed for weight to be distributed to outer perimeters of the foot for maximum weight distribution.

The present invention is designed for portability allowing the cheerleader to train anywhere without needing assistance from a teammate. The design is unique and effective duplicating and replicating a cheerleader's true motion of being lifted in the air. It allows a cheerleader to fine-tune his/her flying skills. It mimics being lifted by a teammate, making the user rely on only one foot, not both as if on the ground. It allows the athlete to use the other foot for making figures/stylistic movements/skills/stunts/acrobatic motion as is required in an actual performance. It allows cheerleaders to use either foot to balance their training on both sides of their body equally. It increases muscle-sensory and vertical-height awareness. It gives control and confidence to the athlete. The design is flexible. It can be accessorized with vinyl and decorative deals, allowing the cheerleader's individuality to be expressed. Teams can add their team colors. The present invention can be used as a seat while waiting. It can be used as a leg-stretching appratus, training leg-dips. Two put together can be used to do deep push-ups. It can be used as a night/day stand, a shoe shining stool, a table-top, and a stepping stool. It is light weight making easy to carry. It is strong allowing a person of any size, i.e. coach/parent, to get on it to instruct and demonstrate a certain movement or pose.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A cheerleader support system comprising:

a vertically oriented shaft having an upper end and a lower end with a vertically oriented central axis;

a lower plate having a configuration with an upper surface integrally formed with the lower end of the shaft;

an upper plate having a geometric configuration with a periphery, the upper plate having a lower surface integrally formed with the upper end of the shaft, the upper plate having an upper surface;

a base plate having a center located on the central axis of the shaft, the base plate having an upper surface in facing contact with and separably coupled to the lower surface of the lower plate, the system having a reduced center of gravity for maximum safety, particularly for pre-teen users; and lateral braces extending between the upper plate and the lower plate, the lateral braces including two wide braces and two narrow braces, weight reducing apertures in the wide braces adjacent to the upper plate to lower the center of gravity of the system so as to maximize safety through abatement of unintended tipping.

2. The system as set forth in claim 1 wherein the upper plate is formed in a generally rectangular configuration with short sides and concave long sides.

3. The system as set forth in claim 1 and further including four threaded fasteners and a recessed support plate, four unthreaded apertures in the support plate and the base plate, four unthreaded apertures in the lower plate wherein the base plate is coupled to the lower end of the shaft by the threaded fasteners.

4. The system as set forth in claim 1 wherein the height of the system is between 7 and 11 inches and the diameter of the base plate is between 16 and 20 inches whereby the system has a height to width ratio of 1 to 2.

5. The system as set forth in claim 1 and further including two arcuate lifting holes in the base plate, each arcuate lifting hole adapted to receive a peg extending from a wall for supporting the system at an elevated location for storage.

6. The system as set forth in claim 1 and further including:

a friction sheet having an upper surface and a lower surface and a periphery corresponding to the periphery of the upper plate, the lower surface having an adhesive attaching the friction sheet to the upper plate, the upper surface having a pattern of raised lines to increase friction between the system and a user during use.

7. The system as set forth in claim 1 and further including:

eight pilot holes extending into the base plate in a concentric, circular configuration radially spaced from the shaft, the eight pilot holes adapted to receive and support elastomeric pads extending downwardly from the lower surface of the base plate to abate sliding of the system during use.

8. The system as set forth in claim 1 wherein the entire system is fabricated of a rigid metallic material.

9. A cheerleader support system (10) for receiving and holding a cheerleader in a predetermined position while practicing athletic routines requiring flexibility, balance and stamina, the system comprising, in combination:

a vertically oriented central shaft (14) having an upper end and a lower end, the central shaft having a vertically oriented central axis between the upper and lower ends with a length;

a lower plate (18) having a configuration with a center located on the central axis of the central shaft, the lower plate having a flat upper surface integrally formed with the lower end of the central shaft, the lower plate having a flat lower surface, a plurality of apertures in the lower plate;

an upper plate (24) having a generally rectangular configuration with short sides and concave long sides, the upper plate having a flat lower surface integrally formed with the upper end of the central shaft, the upper plate having a center located on the central axis of the central shaft, the upper plate having a flat upper surface for receiving and holding a foot of the cheerleader in a predetermined position while practicing athletic routines requiring flexibility, balance and stamina;

a base plate (28) having a circular configuration with a center located on the central axis of the central shaft, the base plate having a diameter, the base plate having a flat upper surface in facing contact with the lower surface of the lower plate, the lower plate having a flat lower surface positionable upon a floor, a plurality of apertures in the base plate axially aligned with a plurality of apertures of the lower plate, a cylindrical recess (32) having a diameter and being centrally located in the lower surface of the base plate;

a retainer disk (36) having a diameter located within the recess, a plurality of apertures in the retainer disk axially aligned with the apertures of the lower plate and the base plate, a plurality of bolts (40) extending through the apertures of the disk, base plate and lower plate to threadedly join the system for use;

at least one arcuate lifting holes (44) in the base plate, each arcuate lifting hole adapted to receive a peg (46) extending from a wall for supporting the system at an elevated location for storage;

lateral braces extending between the upper plate and the lower plate, the lateral braces including wide braces (48) and narrow braces (50) weight reducing apertures (52) in the wide braces adjacent to the upper plate to lower the center of gravity of the system so as to maximize safety through abatement of unintended tipping, the wide braces and the lifting holes being in diametric alignment;

a friction sheet (54) having an upper surface and a lower surface and a periphery corresponding to the periphery of the upper plate, the lower surface having an adhesive (56) attaching the friction sheet to the upper plate, the upper surface having a pattern of anti skid material (58) to increase friction between the system and the cheerleader during use; and pilot holes (60) extending into the base plate in a concentric, circular configuration radially spaced from the shaft, the pilot holes adapted to receive and support elastomeric pads extending downwardly from the lower surface of the base plate to abate sliding of the system during use.

10. The cheerleader support system (10) as set forth in claim 9 wherein the length of the central shaft is 9 inches, plus or minus 20 percent.

11. The cheerleader support system (10) as set forth in claim 9 wherein the lower plate has a diameter of 4.625 inches, plus or minus 20 percent, and the plurality of apertures in the lower plate is four apertures and the plurality of apertures in the base plate is four apertures.

12. The cheerleader support system (10) as set forth in claim 9 wherein the upper plate has a maximum length of 9 inches, plus or minus 20 percent, and a maximum width of 3.6 inches, plus or minus 20 percent.

13. The cheerleader support system (10) as set forth in claim 9 wherein the diameter of the base plate is 18 inches, plus or minus 20 percent, the diameter of the cylindrical recess (32) is 4.5 inches, up to 20 percent less, and the retainer disk (36) has a diameter of 4.5 inches, down to 20 percent.

14. The cheerleader support system (10) as set forth in claim 9 wherein the plurality of apertures in the retainer disk is four apertures and the plurality of bolts (40) is four bolts.

15. The cheerleader support system (10) as set forth in claim 9 wherein the height of the system is between 7 and 11 inches and the diameter of the base plate is between 16 and 20 inches whereby the system has a height-to-width ratio of 1 to 2.

16. The cheerleader support system (10) as set forth in claim 9 wherein the at least one arcuate lifting hole (44) is two lifting holes.

17. The cheerleader support system (10) as set forth in claim 9 wherein the lateral wide braces (48) are two wide braces and the narrow braces (50) are two narrow braces.

18. The cheerleader support system (10) as set forth in claim 9 wherein the plurality of pilot holes (60) extending into the base plate is eight pilot holes.

* * * * *